US005464101A

United States Patent [19]

Freissle

[11] Patent Number: 5,464,101

[45] Date of Patent: Nov. 7, 1995

[54] SCREENING ARRANGEMENT

[76] Inventor: Manfred F. A. Freissle, P.O. Box 123771, Alrode, Alberton, Transvaal Province, South Africa

[21] Appl. No.: 195,685

[22] Filed: Feb. 16, 1994

[30] Foreign Application Priority Data

Jun. 23, 1993 [ZA] South Africa ..... 93/4515
Jan. 21, 1994 [ZA] South Africa ..... 94/0452

[51] Int. Cl.[6] ..... B07B 1/49

[52] U.S. Cl. ..... 209/405; 209/408; 209/411; 209/412

[58] Field of Search ..... 209/405, 408, 209/409, 411, 412, 414, 415, 395, 399, 403

[56] References Cited

U.S. PATENT DOCUMENTS

| | | | |
|---|---|---|---|
| 4,383,919 | 5/1983 | Schmidt | 209/405 X |
| 4,670,136 | 6/1987 | Schmidt et al. | 209/399 X |
| 4,863,597 | 9/1989 | Gilles et al. | 209/399 X |
| 4,871,288 | 10/1989 | Schmidt et al. | 209/399 X |
| 4,882,044 | 11/1989 | Freissle | 209/405 X |
| 4,892,767 | 2/1990 | Freissle . | |
| 5,049,262 | 9/1991 | Galton et al. | 209/408 X |
| 5,112,475 | 5/1992 | Henry, Jr. | 209/403 X |

*Primary Examiner*—David H. Bollinger
*Attorney, Agent, or Firm*—James Ray & Associates

[57] ABSTRACT

The invention provides for a screen support frame component, and for a screen support frame including such a component, in which the component comprises an elongate bar having at least one tubular element affixed thereto. The tubular element defines a socket in which securing means for securing the panel is receivable.

8 Claims, 2 Drawing Sheets

SCREENING ARRANGEMENT

BACKGROUND OF THE INVENTION

This invention relates to a screening arrangement. More particularly the invention relates to a screening arrangement for screening particulate material such as mineral ores or the like. In particular the invention relates to a screen support frame component and to a screen frame including such a component.

Screen support frames for supporting modular removable screening panels are known to the applicant. The known screen support frames are made of steel channel sections or angle sections in which the screening panels are secured in apertures extending through the flanges or webs of the steel sections. A disadvantage of the known screen support frames for certain uses is that the flanges or webs of the steel sections due to their width cause a certain amount of obstruction and therefore reduce the flow of material through the screening panels.

It is an object of the invention to provide a screen support frame which will overcome or alleviate the disadvantage of screen support frames presently known to the applicant.

SUMMARY OF THE INVENTION

According to the invention there is provided a screen support frame component comprising an elongate bar having at least one tubular element affixed thereto defining a socket in which securing means for securing a screening panel is receivable.

The elongate bar may have an angular cross-sectional profile, and specifically may have a rectangular cross-sectional profile of oblong shape.

When the cross-sectional profile of the elongate bar is of oblong shape the tubular element may be affixed to the bar such that the longitudinal axis of the tubular element extends in the direction of the longitudinal axis of the oblong cross-sectional profile of the bar.

The tubular element may be affixed to the elongate bar by providing a recess in the bar in which the tubular element is receivable. The tubular element may be affixed to the bar by means of welding.

The tubular element may have a circular cross-sectional profile. It may further have an annular ridge positioned axially inwardly of its one end for engaging and gripping securing means for securing a screening panel.

The tubular element may be affixed to the elongate bar such that its open end in which securing means for securing a screening panel is receivable is flush with the surface of the elongate bar to which the tubular element is affixed.

Conveniently, two or more tubular elements may be affixed to the elongate bar, the tubular elements being spaced from each other by distances complementary to the spacing between securing means by means of which a screening panel can be secured to the elongate bar.

The width of the elongate bar may be less than the cross-sectional dimension of the socket.

Further according to the invention there is provided a screen support frame which includes at least one screen support frame component in accordance with the invention.

The screen support frame may include at least two screen support frame components in accordance with the invention spaced from and parallel to each other and spaced apart from each other by at least two spacer bars.

Conveniently, a screen support frame in accordance with the invention may comprise a grid-like structure which includes a plurality of screen support frame components in accordance with the invention arranged parallel to each other and spaced apart from each other by means of a plurality of transversely extending spacer bars.

DESCRIPTION OF THE DRAWINGS

The invention is now described with reference to the accompanying drawings, in which:

Referring to FIGS. 1 to 4 of the drawings, reference numeral 10 indicates in general a screen support frame component in accordance with the invention. The component comprises a bar 12 of steel which has a rectangular cross-section of oblong shape with a width 14 and a height 16. In a particular configuration the width 14 may be 10 mm and the height 16 may be 100 mm. Cleats 18 are provided for securing the bar 12 to a support structure (not shown). The cleats 18 are secured to the bar 12 by means of bolts 20 and nuts 22. Holes 24 are provided through the cleats 18 through which bolts (not shown) are fitted for securing the cleats 18 to a support structure (not shown).

Figure 1:
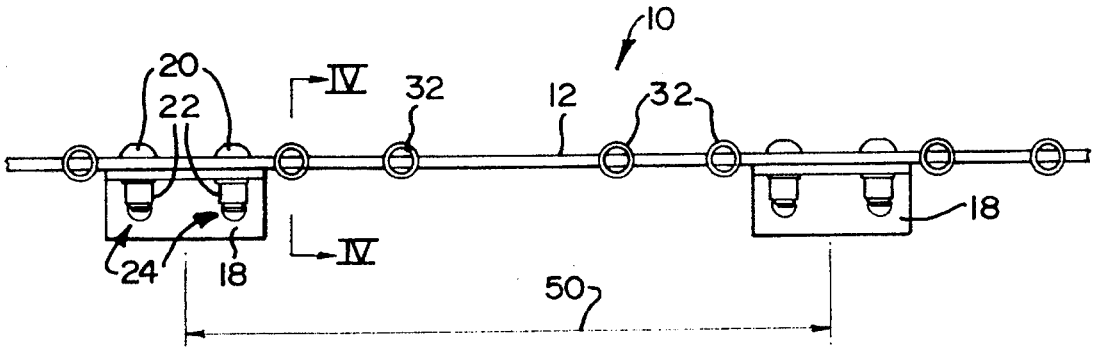
FIG. 1 shows a fragmentary plan view of a screen support frame component in accordance with the invention.

Recesses 26 having rounded ends 28 are provided in the upper surface 30 of the bar 12. In each recess 26 there is fitted a tubular element 32 by means of welding.

Figure 3:
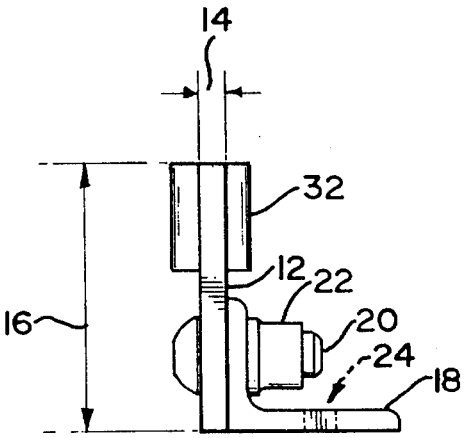
FIG. 3 shows on an enlarged scale an end view of the screen support frame component shown in FIG. 1.
Figure 4:
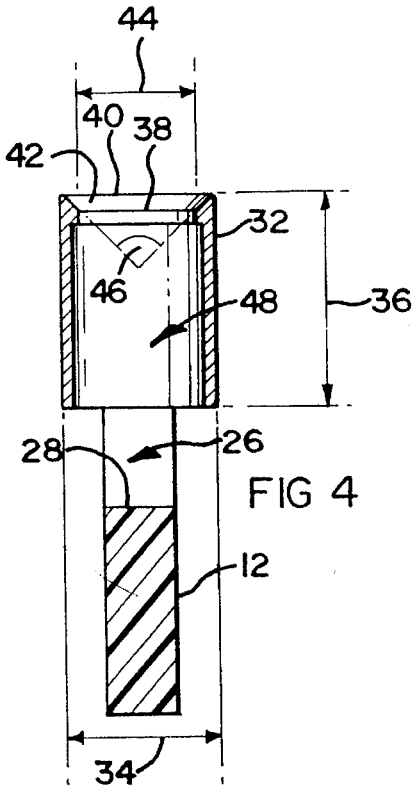
FIG. 4 shows on an enlarged scale a section on line IV—IV of the tubular element shown in FIG. 1.

Referring to FIGS. 3 and 4, the tubular element 32 is shown in greater detail. It is of circular cross-section having a diameter 34 and a height 36. In a particular arrangement the diameter 34 may be 30 mm and the height 36 may be 40 mm. An annular ridge 38 is provided inwardly of the top end 40 of the tubular element 32. A chamfered face 42 extends between the upper end 40 of the tubular element 32, and the ridge 38. The annular ridge 38 has a diameter 44 which in a particular configuration may be 23 mm. An angle 46 is included between the sloping faces of the chamfer 42, and the angle 46 may be 90°. The tubular element 32 is of steel and defines a socket 48 in which securing means is accommodated for securing a screening panel on the bar 12. The securing means is described later with reference to FIGS. 5 and 6.

Figure 2:
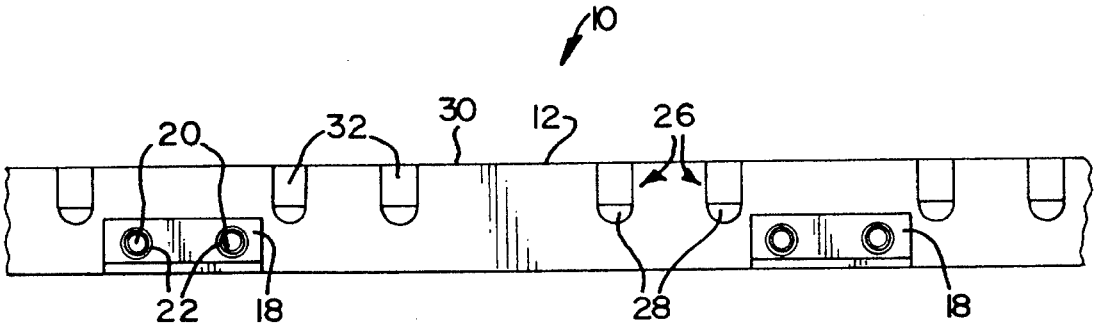
FIG. 2 shows a side view of the screen support frame component shown in FIG. 1.
Figure 5:
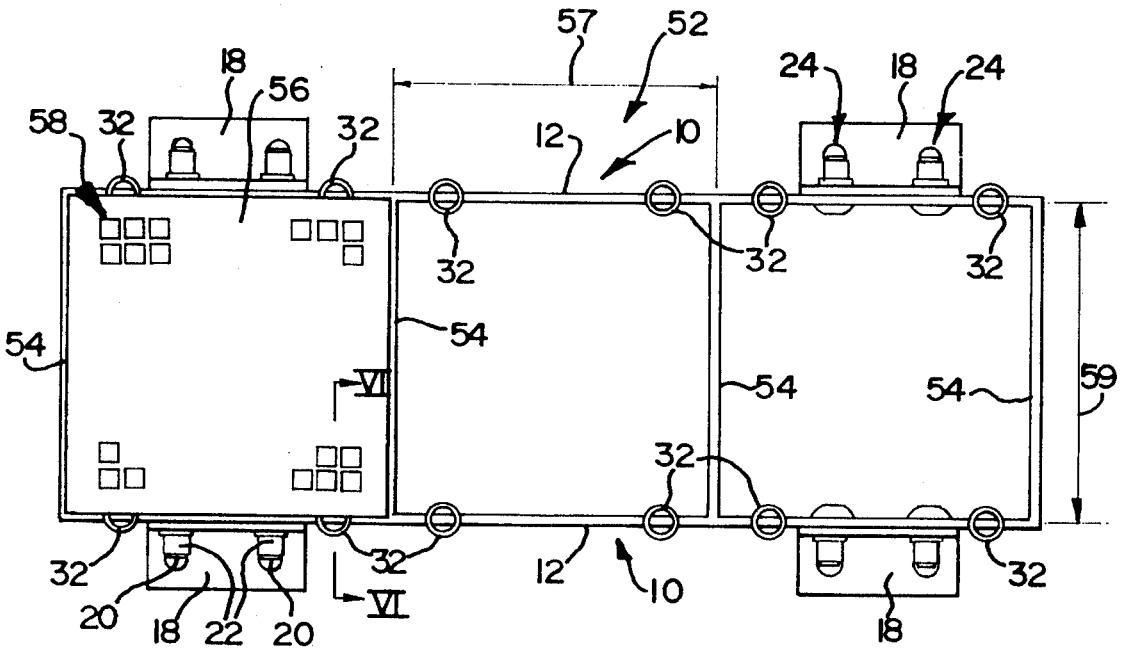
FIG. 5 shows a plan view of a screen support frame including a pair of the screen support components shown in FIG. 1, and a screening panel on the frame.

Referring further to FIGS. 1 and 2, four tubular elements 32 are provided in the bar 12. The number of tubular elements and the spacing between them are determined by the number of securing means, and the spacing between them, provided for securing a screening panel as shown in FIG. 5, on the bar 12. In the arrangement shown in FIG. 1, the bar 12 and the tubular elements 32 are arranged to support a screening panel having two securing protrusions on two opposite sides of the panel as shown in FIG. 5. In this configuration the spacing 50 between the cleats 18 is 610 mm which is equal to two screening panels of 305 mm×305 mm size.

Figure 6:
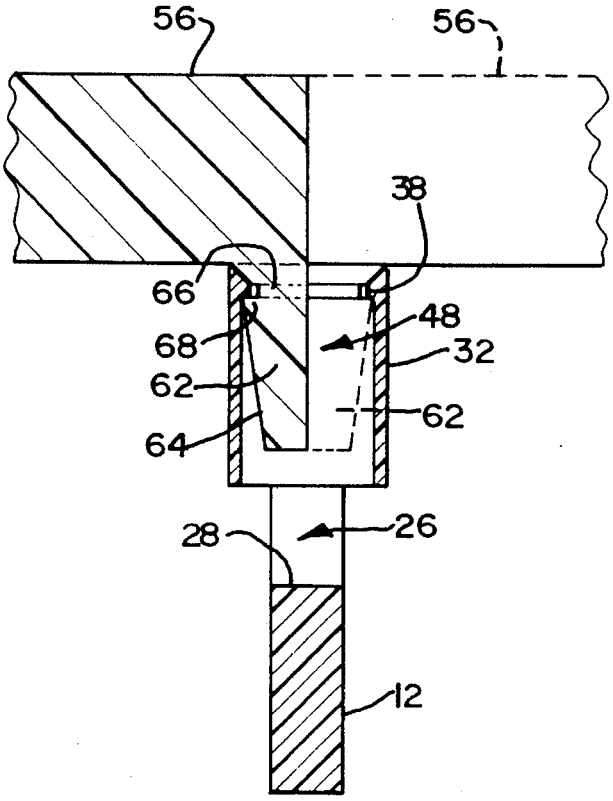
FIG. 6 shows on an enlarged scale a section on line VI—VI of the screen support frame shown in FIG. 5.

Referring to FIGS. 5 and 6, reference numeral 52 indicates a screen support frame including a pair of the screen support frame components 10 shown in FIGS. 1 and 2. The bars 12 of the components 10 are spaced from each other by means of steel spacer bars 54. A screening panel 56 having screening apertures 58 is positioned on the support frame 52. In the arrangement shown in FIG. 5, the screening panel 56 is dimensioned 305 mm×305 mm. The dimension 57 which is the centre line to centre line spacing between the spacer bars 54, and the dimension 59 which is the centre line to centre line spacing between the bars 12, are each also 305 mm. If the width of the bar 12 is 10 mm and the width of the spacer bars 54 is also 10 mm, it means that when the screening panel 56 is placed on the support frame 52, it covers one half of the width of the spacer bars 54 and of the bars 12 i.e. in this particular configuration a space of 5 mm. The effect of this is that when another identical screening panel 56 is placed on the support frame 52 adjacent the first screening panel 56, the screening panels abut each other and are each supported on half the width of the spacer bars 54 i.e. each is supported on a width of 5 mm of the spacer bars 54.

Referring to FIG. 5, the securing of the screening panel 56 of FIG. 5 is shown. The screening panel 56 is of polyurethane and has a protrusion 62 unitary with the screening panel 56. The protrusion 62 has a sloping face 64, a stem 66, and a step 68 between the stem 66 and the sloping face 64. The protrusion 62 is accommodated in the socket 48 defined in the tubular element 32 which is mounted in the recess 26 in the bar 12. The step 68 engages behind the annular shoulder 38 in the tubular element 32 and thereby secures the screening panel 56 on the tubular element 32 and on the bar 12 of the support frame 52 shown in FIG. 5. When two screening panels 56 are positioned side-by-side on the tubular element 32 and on the bar 12, as shown in FIG. 6, one screening panel 56 being shown in solid lines and the other been shown in broken lines, the protrusions 62 on the screening panels are fitted in pairs in the socket 48 defined in the tubular element 32. The protrusions 62 are forced via their sloping surfaces 64 through the annular shoulder 38 into the socket 48 until the steps 68 engage behind the shoulder 38. This is possible since the polyurethane of which the panels 56 and the protrusions 62 are made is resiliently deformable. When the steps 68 are thus positioned behind the shoulder 38 the panels 56 are secured on the bar 12 and thus onto the support frame 52.

The protrusions 62 on the screening panel 56 as shown in FIG. 6, are fixed protrusions. In an alternative arrangement, not shown, the protrusions 62 may be hollow and a separate pin (not shown) may be inserted through the cavity in the protrusion to force it into engagement behind the shoulder 38.

By having bars 12 as screen support frame components for making up a screen support frame 52, instead of having channel sections or angle sections as in the prior art, the open area between the bars 12 and the spacer bars 54 can be increased to a maximum to thereby cause as little obstruction as possible to the flow of screened material through the screening panel 56 and through the support frame 52. As pointed out above, the width of the bars 12 and of the support bars 54 in the particular arrangement are 10 mm which is a substantial reduction from a width in the order of 30 mm or more of channels and angle sections used in the prior art for making screen support frames. The reduction in the width of the bar forming the screening support frame component is possible due to the feature of the invention namely to affix tubular elements in the support bar defining sockets in which securing means can be received for securing screening panels to the support frame.

I claim:

1. A screen support frame component comprising an elongate bar having at least one tubular element affixed thereto, the tubular element having a tubular wall and two ends, one end being an open end, and further defining a socket in said tubular wall inwardly of said open end in which securing means for securing a screening panel is receivable, said socket having a longitudinal axis and said elongate bar having a rectangular cross-sectional profile forming a height and a width of said elongate bar, said height extending in the longitudinal direction of said profile and said width extending transversely to said height and being smaller than said height, said width of said elongate bar being small than the cross-sectional dimension of said socket in a direction transverse to said longitudinal axis of said socket and extending across said width of said elongate bar.

2. A screen support frame component as claimed in claim 1, in which said tubular element is affixed to said bar such that said longitudinal axis of said tubular element extends in the direction of said height of said cross-sectional profile of said bar.

3. A screen support frame component as claimed in claim 1, in which the tubular element is affixed to the elongate bar by providing a recess in the bar in which the tubular element is receivable.

4. A screen support frame component as claimed in claim 1, in which said tubular element has a circular cross-sectional profile and further has an annular ridge positioned axially inwardly of said open end for engaging and gripping securing means for securing a screening panel.

5. A screen support frame component as claimed in claim 1, in which the tubular element is affixed to the elongate bar such that said open end in which securing means for securing a screening panel is receivable is flush with the surface of the elongate bar to which the tubular element is affixed.

6. A screen support frame component as claimed in claim 1, in which two or more tubular elements are affixed to the elongate bar, the tubular elements being spaced from each other by distances complementary to the spacing between securing means by means of which a screening panel can be secured to the elongate bar.

7. A screen support frame which includes at least two screen support frame components as claimed in claim 1 spaced from and parallel to each other by at least two spacer bars extending transversely between said screen support components.

8. A screen support frame as claimed in claim 7, in which said screen support frame components and said transversely extending spacer bars from a grid.

* * * * *